US005947315A

United States Patent [19]

Valyi et al.

[11] Patent Number: 5,947,315

[45] Date of Patent: Sep. 7, 1999

[54] TWO PIECE CONTAINER CLOSURE ASSEMBLY WITH FRANGIBLE INNER CLOSURE

[75] Inventors: Emery I. Valyi, Katonah, N.Y.; Herbert Rees, Orangeville, Canada

[73] Assignee: The Elizabeth and Sandor Valyi Foundation, Inc., New York, N.Y.

[21] Appl. No.: 09/014,085

[22] Filed: Jan. 27, 1998

[51] Int. Cl.[6] ..... B65D 17/44

[52] U.S. Cl. ..... 220/258; 220/278; 222/83; 222/541.2; 222/541.5; 222/541.8

[58] Field of Search ..... 220/258, 277, 220/278, 265, 267; 215/250, 252, 258, 257, 228, 356, DIG. 8; 206/219, 222; 222/541.5, 541.8, 541.2, 81, 83, 83.5, 88

[56] References Cited

U.S. PATENT DOCUMENTS 3,787,547 1/1974 Stephan .
5,325,976 7/1994 Valyi et al. .
5,562,226 10/1996 Valyi et al. .
5,704,501 1/1998 Valyi .

*Primary Examiner*—Stephen K. Cronin
*Assistant Examiner*—Nathan Newhouse
*Attorney, Agent, or Firm*—Bachman & LaPointe, P.C.

[57] ABSTRACT

The closure assembly includes: a container having an access opening; an inner closure with a rim attached to the container, a central portion covering the access opening, a weakened portion in the central portion, and a separably interlocking portion in the central portion, as a threaded portion; a removable closure covering the inner closure and separably interlocking the inner closure; whereby twisting the removable closure as by threading action on the inner closure breaks the inner closure at the weakened portion and opens the container. Also discloses a method for opening a closure assembly.

18 Claims, 4 Drawing Sheets

TWO PIECE CONTAINER CLOSURE ASSEMBLY WITH FRANGIBLE INNER CLOSURE

BACKGROUND OF THE INVENTION

The present invention relates to a container closure assembly and a method for opening a container closure assembly.

It is highly desirable to provide a container closure assembly which may be easily opened and reclosed without the use of a tool, especially with a tamper evident closure and also desirably incorporating a gas permeation barrier. It is particularly desirable to provide such a closure where it is necessary to maintain the integrity of the contents prior to opening, as for example, with carbonated beverages, and to enable re-closing the container with partially emptied contents. Thus, the closure should at least in part include a gas impermeable element or layer in order to maintain the integrity of the container contents prior to opening and it should also be capable of showing whether or not the container has been tampered with prior to opening.

It has been difficult to accomplish the foregoing with plastic closures, especially with closures which are convenient to use for a wide range of neck diameters including large diameters.

U.S. Pat. No. 5,325,976 to Valyi et al. shows a multilayered closure assembly with stepped portions, whereby twisting the closure member places the stepped portions under torsion and breaks a barrier layer at a weakened portion thereof and opens the container. U.S. Pat. No. 5,704,501 to Valyi also shows a multilayered closure assembly with a weakened, crystallized brittle portion in a barrier layer, whereby twisting a closure member breaks the barrier layer at the weakened portion and opens the container. U.S. Pat. No. 5,562,226 to Valyi et al. also shows a multilayered closure assembly where twisting of a closure member breaks a barrier layer at a weakened portion and opens the container.

It is an object of the present invention to provide a further improvement in the aforesaid container closure assemblies, barrier performance and which remains simple and convenient to operate.

It is a still further object of the present invention to provide an assembly as aforesaid which maintains the integrity of the contents prior to opening, which includes a tamper evident closure, and which enables re-closing of the container.

It is a further object of the present invention to provide an assembly as aforesaid which is easy to prepare, inexpensive and easy to use in practice.

Further objects and advantages of the present invention will appear hereinbelow.

SUMMARY OF THE INVENTION

In accordance with the present invention the foregoing objects and advantages are readily obtained.

A container closure assembly is provided in accordance with the present invention including: a container having an access opening for the container; an inner closure having a rim portion attached to the container and a central portion, said inner closure completely covering the access opening, said inner closure including a weakened portion in the central portion and a separably interlocking portion, for example, a threaded portion, in the central portion; a removable closure member covering said inner closure and intimately contacting said inner closure, said removable closure including a separably interlocking portion separably engaging the said separable portion of said inner closure; whereby, twisting the removable closure member, for example, by threading action of the removable closure on the inner closure breaks the inner closure at the weakened portion and opens the container.

Desirably, breaking the inner closure at its weakened portion by twisting the removable closure in a first direction is followed by twisting the removable closure in a second direction to remove the removable closure together with the central portion of the inner closure. Twisting the removable closure as above exerts an axial force against the inner closure which is transmitted to the weakened portion and breaks the weakened portion.

The present invention also comprises a method for opening a closure assembly, which includes: providing a container having an access opening therein; completely covering the access opening with an inner closure having a rim portion attached to the container and a central portion; providing a weakened portion and a separably interlocking portion in the central portion of the inner closure; covering the container access opening and inner closure with a removable closure which includes a separably interlocking portion thereof and which intimately contacts the inner closure; engaging the interlocking portions of the removable closure and of the inner closure; and twisting the removable closure by action of the removable closure on the inner closure to break the inner closure at the weakened portion and thereby open the container.

Further features of the present invention will appear from the following specification.

BRIEF DESCRIPTION OF THE DRAWINGS

The present invention will be more readily understandable from a consideration of the following illustrative and partly schematic drawings, wherein.

DETAILED DESCRIPTION OF PREFERRED EMBODIMENTS

Figure 1:
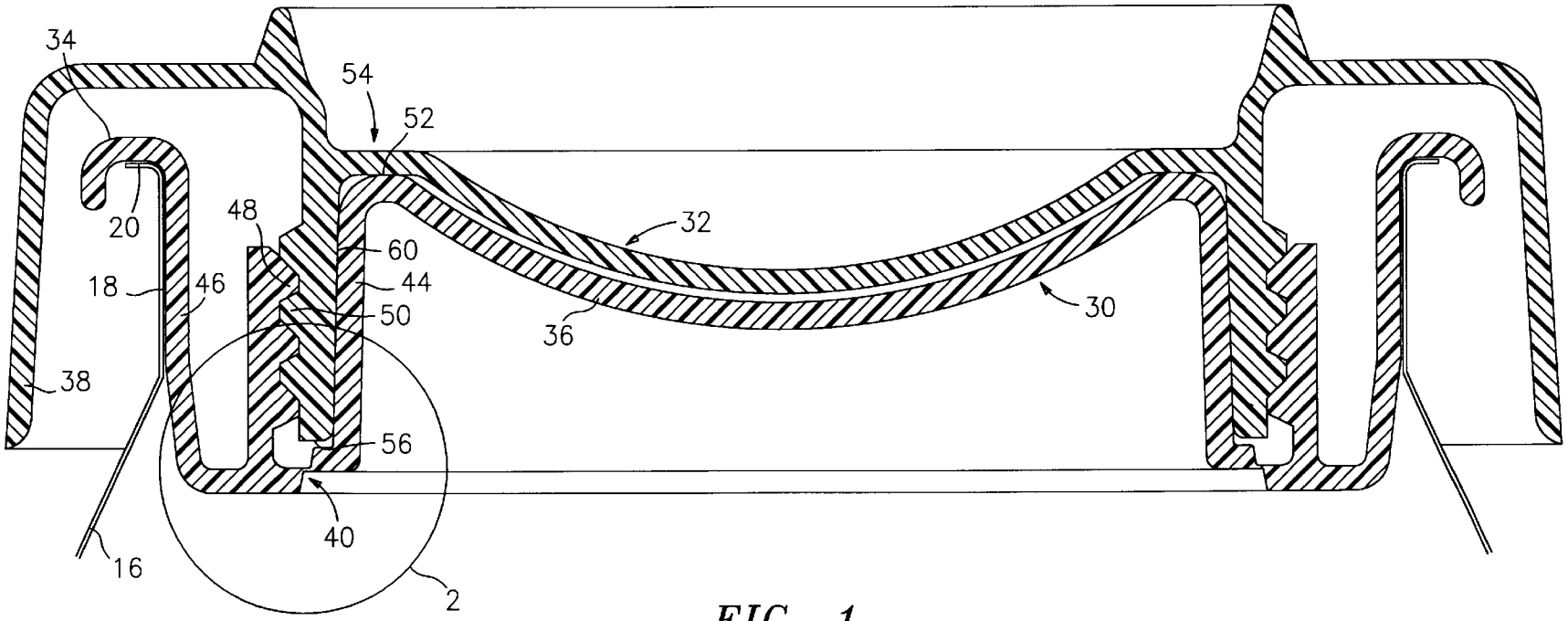
FIG. 1 is a sectional view of a container closure assembly of the present invention.
Figure 3:
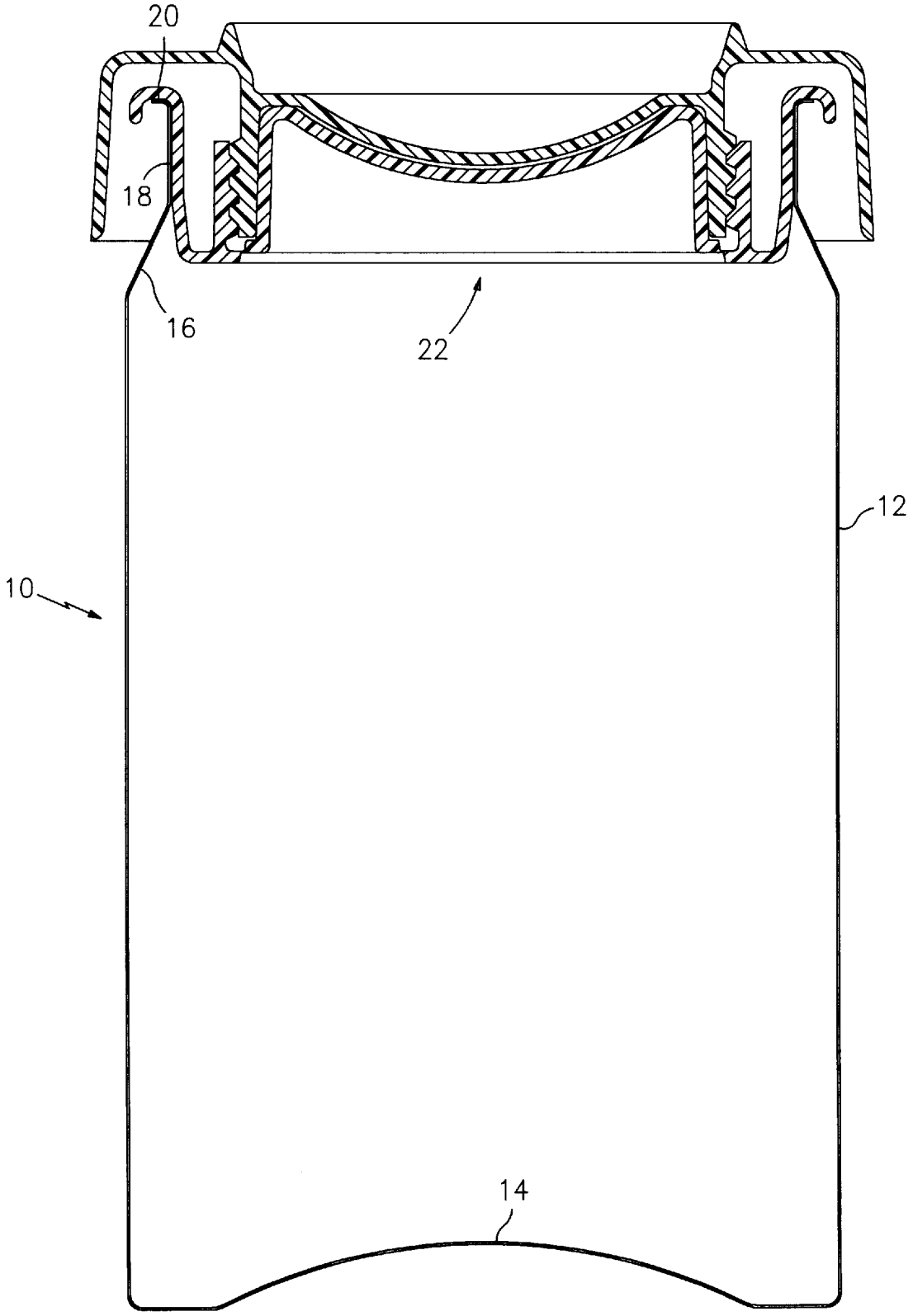
FIG. 3 is a sectional view of the container closure assembly of the present invention in engagement with a container.

FIGS. 1 and 3 show sectional side views of a container closure assembly of the present invention in the closed condition in engagement with a container. Container 10 includes a container side wall 12 extending upwardly from a container bottom 14, container shoulder 16 extending upwardly from the container side wall, container neck 18 extending upwardly from the shoulder portion and terminating in a container rim portion 20 defining an access opening 22 for container 10. The container 10 may be made from any suitable material, such as a plastic as polyethylene terephthalate, or a metal as aluminum.

The container closure assembly of the present invention seen in the enlarged sectional view of FIG. 1 includes an inner closure 30 and an outer removable closure member 32 covering the inner closure.

The inner closure 30 is desirably a plastic barrier layer which may be made of the same plastic as the container if said plastic has adequate resistance to gas permeation as the container. Thus, if the container is made of the types of PET normally used for beverage bottles, the barrier layer may be made of the same grade of PET or one that is more permeation resistant, e.g., due to high crystallinity, or it may contain a better barrier, such as EVOH, providing that it is compatible with the first mentioned PET for recycling. The barrier layer may be metal, e.g., aluminum, particularly for use with a metallic container. The closure member must be made of a rigid material and may, if plastic, be made transparent so that the barrier layer can be seen. The barrier layer may be made by thermoforming, injection molding or compression molding, for example.

Inner closure layer 30 has a rim portion 34 and a central portion 36 and completely covers access opening 22. Preferably, for pressurized containers, at least a part of central portion 36 is domed as shown in FIG. 1. Rim portion 34 is firmly attached to container rim 20, as for example by the use of an interference fit or by adhesive or friction bonding, to provide a gas impervious closure attachment for the unopened container.

Figure 4:
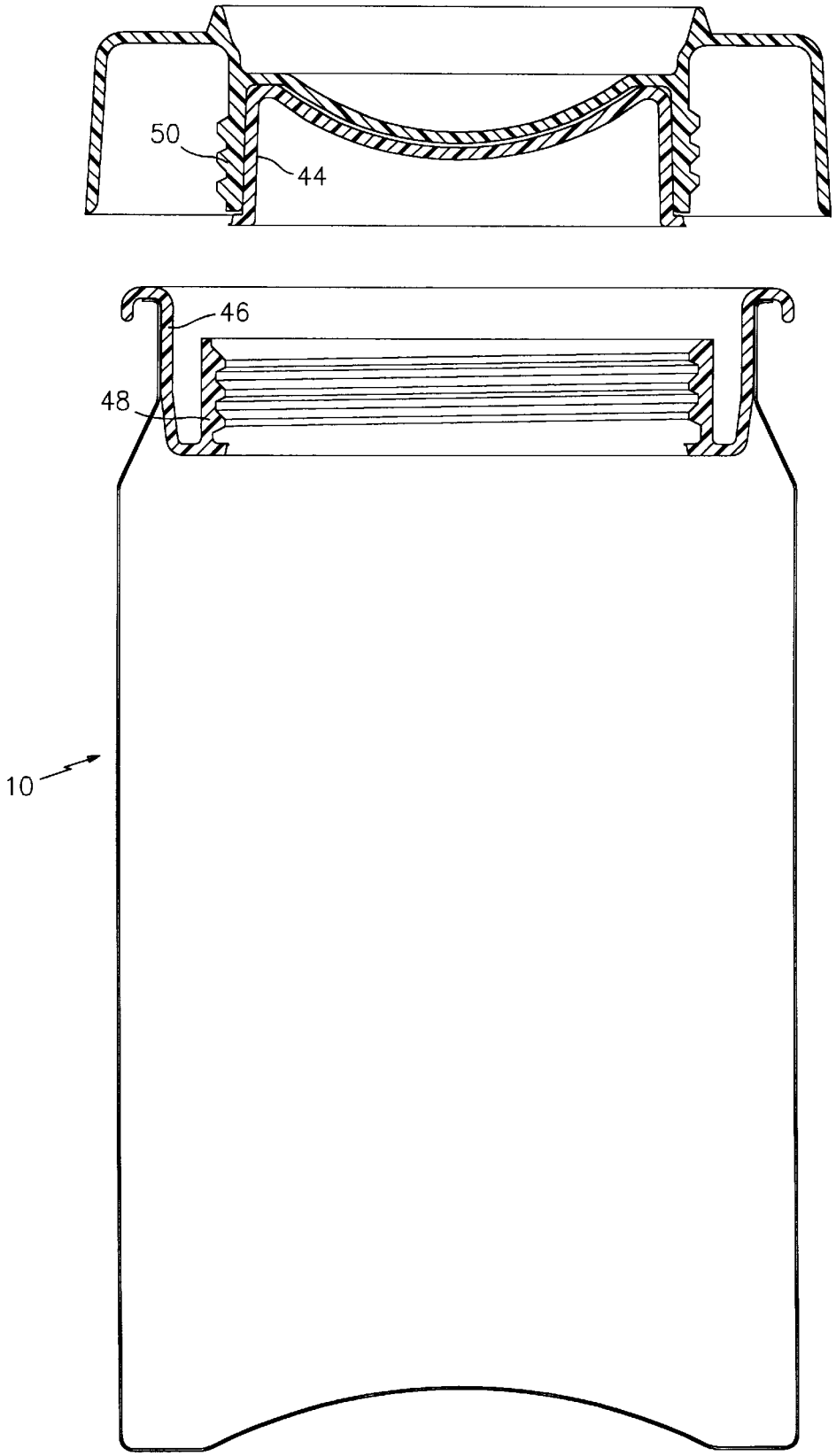
FIG. 4 is a sectional view of the assembly of FIG. 3 with the removable closure member removed.

Removable closure member 32 is provided over container 10 covering the inner closure plus the container rim and preferably at least a portion of the container neck. Closure member 32 may include a downwardly descending skirt 38 spaced from inner closure rim 34 as shown in FIGS. 1 and 3, or the downwardly descending skirt 38 may engage inner closure rim 34, if desired. The removable closure, including the downwardly descending skirt, should be readily removable from the container as shown in FIG. 4.

Figure 2:
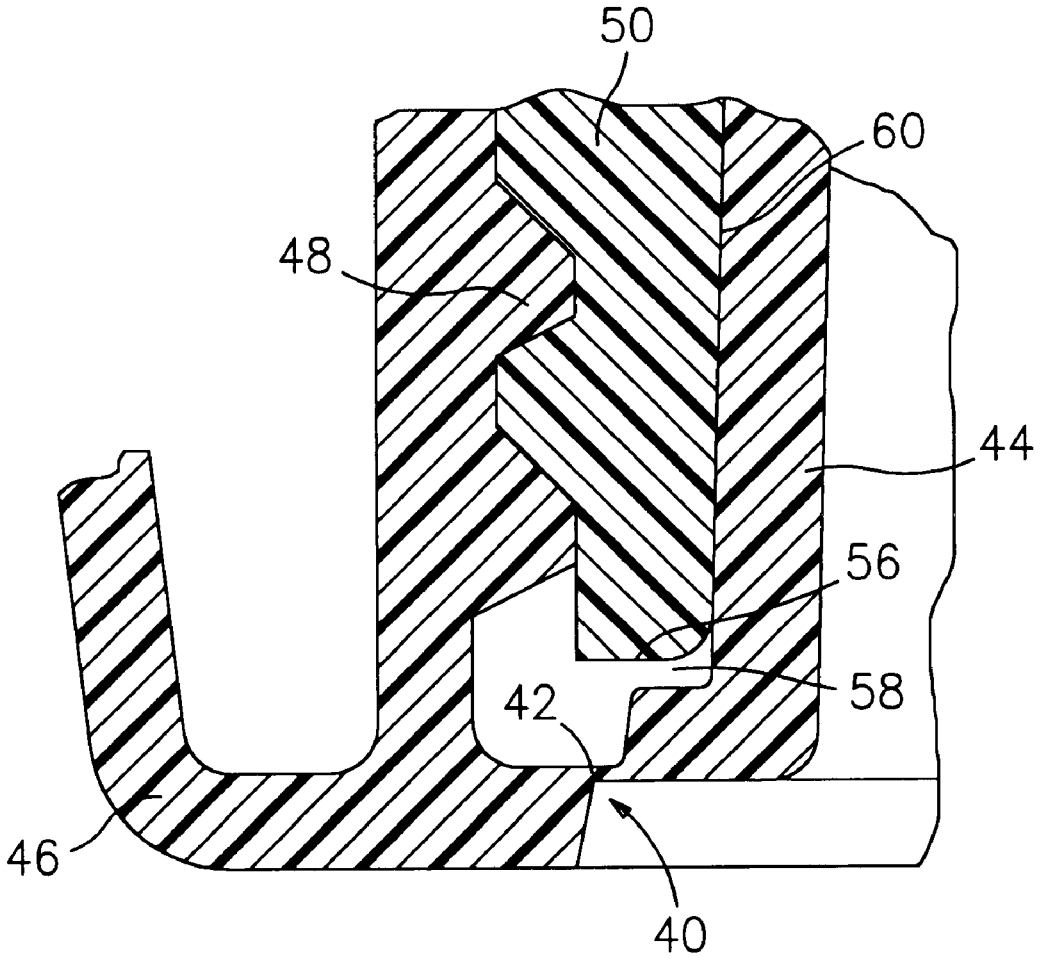
FIG. 2 is an enlarged sectional view of the threaded engagement between the inner closure and the outer removable closure member of the container closure assembly as shown in portion 2 of FIG. 1.

Inner closure 30 includes a weakened portion 40 in the central portion thereof intended to be sheared when the outer closure 32 is twisted as described below. The weakened portion may be a film-like link 42 as clearly shown in FIG. 2, or any other desired shear sensitive structure, as for example a notch or a brittle seam or combinations of these. The weakened portion should be such as to permit easy separation by a relatively small axial force of an inside portion 44 of the inner closure 30 from an outside portion 46 of the inner closure, i.e., separation of the inner closure into two parts. In addition, inner closure includes a separably interlocking portion shown as a threaded portion 48 on an upwardly extending annular leg.

Removable outer closure 32 includes a separably interlocking portion shown as threaded portion 50, on a downwardly extending annular leg, engaging the threaded portion 48 of the inner closure.

As shown, removable closure member 32 and inner closure 30 are assembled by threading together until they abut at stop 52 which precludes continued relative movement of the removable and inner closures 30 and 32 due to the engagement without an axial force being transmitted by the removable closure to the inner closure in the direction of arrow 54. In this closed position, an end 56 of the threaded portion 50 of outer closure 32 remains spaced from weakened portion 40 via space 58. This provides a secure assembly of the inner closure 30 and outer closure 32 on container 10, with the outer closure intimately contacting the inner closure.

The container is opened by continuing the twisting action, as by the threading action of the overcap 32 onto the inner closure 30 past the point reached in assembling these two components. Thereby an axial force is exerted against stop 52 by overcap 32 in the direction of arrow 54. The outer portion 46 of inner closure 30, being fixed to container rim 20 and also fixed to neck 18, is precluded from moving. Hence, the entire axial force is applied by force transmitted by portion 44 of inner closure 30 to the weakened portion 40 and more particularly to link 42. This results in link 42 being broken by the axial force, as by shearing, thereby separating inner portion 44 of inner closure 30 from outer portion 46 of inner closure 30.

The overcap 32 and inner closure 30 desirably include matching interfaces, as interface 60, suitably dimensioned to preclude separation of inner portion 44 from overcap 32 following the separation of the inner portion 44 from the outer portion 46 as described above.

With inner portion 44 thus captured, overcap 32 is next twisted in the opposite direction to that of assembly and of shearing the weakened portion. Thereby, with outer portion 46 of inner closure 30 remaining fixed on the container rim, the inner portion 44 together with overcap 32 is unscrewed and these components are removed as shown in FIG. 4 to open the container.

The interlocking configurations, here shown as the thread configuration 48 and 50 and the configuration of weakened portion 40, as for example the thickness of link 42, are designed so as to result in a predetermined axial force for a predetermined torque sufficient to shear the particular material of inner closure 30 at link 42. A desirable torque may, for example, be in the range of 10 to 30 ft. lbs. for easy opening by a comparatively weak person. Assuming, for example, injection molded polyethylene terephthalate as the material, with a shear strength of 5000 psi, a circumference of the weakened section 40 of six inches, the circumference of skirt 38 of eight inches, and a thickness of link 42 of 0.004", the axial force to shear link 42 will be 120 lbs., and the torque required at the periphery of skirt 38 to exert that force approximately 15 ft. lbs., without allowance for friction, i.e., clearly within the capacity of a young adolescent.

The above described closure is tamper evident because two distinct movements are required, twisting in opposite directions in sequence, and there is an audible signal in case of carbonated beverages, in addition to the noticeable difference in the forces to "break-in" and to "open". Moreover, the closure assembly of the present invention is inexpensive, easy to assemble, secure and easy to use. The container may be easily reclosed if desired, albeit without the security of the original closure.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A container closure assembly, which comprises:

a container having an access opening for the container;

an inner closure having a rim portion attached to the container and a central portion, said inner closure completely covering the access opening, said inner closure including a weakened portion in the central portion which defines a removable section of the inner closure and a separably interlocking portion in the central portion;

a removable outer closure member substantially completely covering said inner closure and intimately contacting said inner closure, said removable closure including a separably interlocking portion engaging the separably interlocking portion of said inner closure;

whereby twisting the removable closure on the inner closure exerts an axial force against the inner closure which is transmitted to the weakened portion and breaks the inner closure at the weakened portion, permits removal of the removable outer closure and the removable section of the inner closure from the container and opens the container.

2. An assembly according to claim 1, wherein the separably interlocking portions are provided by threads, and wherein twisting the removable closure by threading action of the removable closure on the inner closure breaks the inner closure at the weakened portion and opens the container.

3. An assembly according to claim 1, wherein at least a part of the central portion of the inner closure is domed.

4. An assembly according to claim 1, wherein the interlocking portion of the removable closure includes a downwardly extending portion with an end portion thereof which is spaced from the inner closure by a gap.

5. An assembly according to claim 1, wherein the inner closure is a barrier layer.

6. An assembly according to claim 1, wherein the weakened portion is adjacent the engagement of the separably interlocking portion of the inner closure and the separably interlocking portion of the removable closure.

7. An assembly according to claim 1, wherein the interlocking portion of the removable outer closure includes a downwardly extending annular leg, and the interlocking portion of the inner closure includes an upwardly extending annular leg mating with the downwardly extending annular leg of the removable outer closure.

8. An assembly according to claim 1, wherein said twisting action of the removable closure by threading action of the removable closure in a first direction on the inner closure breaks the inner closure at the weakened portion, followed by twisting the removable closure in a second direction opposite said first direction to remove the removable closure and said removable section of the inner closure.

9. An assembly according to claim 8, including matching interfaces between the inner closure and the removable closure to preclude separation thereof during removal of the removable closure and said removable section of the inner closure.

10. An assembly according to claim 8, wherein the rim portion of the inner closure remains attached to the container on removal of the removable closure and said removable section of the inner closure.

11. A method for opening a closure assembly, which comprises:

providing a container having an access opening therein;

completely covering the access opening with an inner closure having a rim portion attached to the container and a central portion;

providing a weakened portion and a separably interlocking portion in the central portion of the inner closure, wherein the weakened portion defines a removable section of the inner closure;

substantially completely covering the container access opening and inner closure with a removable outer closure which includes a separably interlocking portion thereof;

engaging the separably interlocking portions of the removable closure and inner closure; and twisting the removable closure by action of the removable closure on the inner closure to exert an axial force against the inner closure which is transmitted to the weakened portion to break the inner closure at the weakened portion, permit removal of the removable outer closure and the removable section of the inner closure from the container and thereby open the container.

12. A method according to claim 11, wherein the separably interlocking portions are provided by threads, and including the step of twisting the removable closure by threading action of the removable closure on the inner closure to break the inner closure at the weakened portion and to open the container.

13. A method according to claim 11, including spacing a downwardly extending portion with an end portion thereof of the separably interlocking portion of the removable closure from the inner closure by a gap.

14. A method according to claim 11, including providing that the inner closure is a barrier layer.

15. A method according to claim 11, including positioning the weakened portion adjacent the engagement of the separably interlocking portion of the inner closure and the separably interlocking portion of the removable closure.

16. A method according to claim 11, including twisting the removable closure in a first direction on the inner closure to break the inner closure at the weakened portion, followed by twisting the removable closure in a second direction opposite said first direction to remove the removable closure and the removable section of the inner closure.

17. A method according to claim 16, including providing matching interfaces between the inner closure and removable closure to preclude separation thereof during removal of the removable closure and the removable section of the inner closure.

18. A method according to claim 16, including leaving the rim portion of the inner closure attached to the container on removal of the removable closure and said removable section of the inner closure.

* * * * *